US010159133B2

(12) United States Patent
Guzik et al.

(10) Patent No.: US 10,159,133 B2
(45) Date of Patent: Dec. 18, 2018

(54) SYSTEM FOR DISTRIBUTING LOW-VOLTAGE DC POWER TO LED LUMINAIRES

(71) Applicant: BlueOcean IoT, LLC, Alexandria, VA (US)

(72) Inventors: Adam Guzik, Cardiff by the Sea, CA (US); Andrew B. Fox, Huntingtown, MD (US); David Conrath, Alexandria, VA (US); Richard Jackson, Alpharetta, GA (US)

( * ) Notice: Subject to any disclaimer, the term of this patent is extended or adjusted under 35 U.S.C. 154(b) by 0 days.

(21) Appl. No.: 15/783,034

(22) Filed: Oct. 13, 2017

(65) Prior Publication Data

US 2018/0110105 A1 Apr. 19, 2018

Related U.S. Application Data

(60) Provisional application No. 62/408,294, filed on Oct. 14, 2016.

(51) Int. Cl.
*H05B 37/02* (2006.01)
*H05B 33/08* (2006.01)

(52) U.S. Cl.
CPC ..... *H05B 33/0863* (2013.01); *H05B 33/0845* (2013.01); *H05B 37/0272* (2013.01)

(58) Field of Classification Search
CPC ..... H05B 33/0845; H05B 33/0872; H05B 37/0227; H05B 37/0245; H05B 37/0272; H05B 37/029
(Continued)

(56) References Cited

U.S. PATENT DOCUMENTS

| | | | |
|---|---|---|---|
| 8,299,987 | B2 | 10/2012 | Neudorf et al. |
| 8,525,446 | B2 | 9/2013 | Tikkanen et al. |
| 8,957,601 | B2 | 2/2015 | Tikkanen et al. |
| 9,049,759 | B2 | 6/2015 | Tikkanen et al. |
| 9,078,310 | B2 | 7/2015 | Tikkanen et al. |

(Continued)

OTHER PUBLICATIONS

Zimmerman, Livesay, Evas, DC-powered modular SSL delivers efficiency and flexibility—LEDs Magazine, Jul. 25, 2016.

(Continued)

*Primary Examiner* — Tung X Le
(74) *Attorney, Agent, or Firm* — Clyde E. Findley

(57) ABSTRACT

Embodiments of the present invention are directed to systems for powering and controlling lighting fixtures in office buildings, homes, industrial facilities, and similar structures using low-voltage direct-current ("DC") electricity. Some embodiments of the present invention are directed to systems for distributing DC power from a lighting controller to various LED luminaires. Embodiments include (a) a power source configured to provide electricity at approximately 48 volts DC; (b) an LED lighting fixture that includes a cool LED luminaire tuned toward the blue end of the visible light spectrum and a warm LED luminaire tuned toward the red end of the visible light spectrum; (c) a variable input control device for setting the color/temperature of the light emitted by the LED lighting fixture; and (d) a lighting controller comprising a watt meter, a capacitor bank, a cool LED controller, a warm LED controller, an input controller, a lighting computer; and (e) a site computer that communicates with the lighting controller via a building network to provide certain operational controls over the LED lighting fixture.

7 Claims, 3 Drawing Sheets

(58) Field of Classification Search
USPC ..... 315/308, 312
See application file for complete search history.

(56) References Cited

U.S. PATENT DOCUMENTS

| | | | | |
|---|---|---|---|---|
| 9,320,093 | B2 | 4/2016 | Tikkanen et al. | |
| 9,433,053 | B2 | 8/2016 | Neudorf et al. | |
| 9,591,713 | B2 | 3/2017 | Tikkanen et al. | |
| 9,635,734 | B2 | 4/2017 | Tyson et al. | |
| 9,657,927 | B1 | 5/2017 | Lanham | |
| 9,717,120 | B2 | 7/2017 | Hui et al. | |
| 2011/0080112 | A1* | 4/2011 | Shearer | H05B 33/0815 315/291 |
| 2011/0127930 | A1* | 6/2011 | Bennette | H05B 33/0863 315/312 |
| 2011/0153201 | A1* | 6/2011 | Park | G01C 21/20 701/533 |
| 2012/0206050 | A1* | 8/2012 | Spero | B60Q 1/04 315/152 |
| 2013/0271004 | A1* | 10/2013 | Min | H05B 33/0842 315/112 |
| 2013/0293156 | A1* | 11/2013 | Wells | H05B 33/0803 315/312 |
| 2014/0015415 | A1* | 1/2014 | Lim | H05B 37/02 315/131 |

OTHER PUBLICATIONS

Wright, Goldeneye linear LED lighting can be integrated into architecture LEDs Magazine, May 16, 2016.
Magnitude Lighting Constant Voltage Drivers.
Magnitude Lighting CVN96x48DC Specification.
Magnitude Lighting T288L24DC Specification.
Magnitude Lighting AFLEX 60W Programmable LED Driver Specification.
https://www.control4.com/solutions/smart-lighting.
https://www.creston.com/products/line/commercial-lighting-control-lights.
https://www.enocean-alliance.org/products.
https://www.enocean.com/en/internet-of-things-applications/wireless-led-controls/.
https://www.fxl.com/product-line/power-and-control.
InetSupervisor G1-Enocean App.
InetSupervisor G1-EnOcean Lighting App.
http://www.hubbell-automation.com/products/networked-lighting-controls.
InetSupervisor G1-MicroRouter.
InetSupervisor Q1-2.10.8.4 Universal Controller.
InetSupervisor RHEA.
InetSupervisor S01 I/O Programmable Controller.
InetSupervisor S02 I/O Programmable Controller.
https://byjasco.com/products/category/home-automation-security/zigbee-lighting-automation.
http://www.leviton.com/en/products/security-automation/lighting.
Lutron LCP 128 System Overview http://www.lutron.com/en-US/Products/Pages/WholeBuildingSystems/LCP128/Overview.aspx.
http://www.lighting.philips.com/main/products/lighting-controls.
https://www.vantagecontrols.com/solutions/lighting-automation.aspx.
http://global.wago.com/en/solutions/building-automation/applications/lighting/automation/index.jsp.

* cited by examiner

SYSTEM FOR DISTRIBUTING LOW-VOLTAGE DC POWER TO LED LUMINAIRES

CROSS-REFERENCE TO RELATED APPLICATIONS

This application claims priority under 35 U.S.C. § 119(e) to U.S. Provisional Patent Application No. 62/408,294, entitled "System for Distributing Low-Voltage DC Power to LED Luminaires," filed Oct. 14, 2016.

FIELD OF THE INVENTION

Embodiments of the present invention relate to an improved system and method of distributing low-voltage DC current to LED lighting modules in office buildings, homes, industrial facilities, and other similar structures. Embodiments of the present invention can replace or obviate the need to use relatively expensive and more dangerous systems for distributing electricity that use comparatively high-voltage AC power. More particularly, embodiments of the present invention provide a new system architecture and more specifically a new apparatus for providing low-voltage DC current to control the operation of LED lighting fixtures.

BACKGROUND

Some prior art lighting solutions for office buildings, homes, industrial facilities, and similar structures include Light Emitting Diode ("LED") luminaire fixtures with integrated current drivers. In these prior art systems, high voltage AC current is run through well-insulated wires and/or conduits to each individual luminaire fixture. There, an internally mounted LED current driver receives a 120-277V AC current and converts it to low voltage DC, which is then provided to individual LEDs within the luminaire fixture. In a typical building, there can be hundreds or thousands of such luminaire fixtures, each including a dedicated LED current driver mounted inside the luminaire fixture.

Due to the high operating temperatures of prior art LED luminaires, as well as the risk of accidental exposure to high voltage AC current, prior art LED luminaires pose safety risks and encourage system efficiency compromises.

SUMMARY OF THE INVENTION

This summary is provided to introduce certain concepts in a simplified form that are further described below in the Detailed Description. This summary is not intended to identify key features or essential features of the claimed subject matter, nor is it intended to limit in any way the scope of the claimed invention.

Where other, prior art systems provide electrical power to devices such as lighting fixtures in the form of high-voltage AC electricity, embodiments of the present invention are directed to systems and methods for powering and controlling lighting fixtures in office buildings, homes, industrial facilities, and similar structures using low-voltage direct-current ("DC") electricity. Some embodiments of the present invention are directed to systems for distributing DC power from a lighting controller to various LED luminaires. Other embodiments of the present invention are directed to systems for improving the electrical efficiency of LEDs. Still other embodiments of the present invention are directed to systems and methods for automating the control of LEDs.

The above summaries of embodiments of the present invention have been provided to introduce certain concepts that are further described below in the Detailed Description. The summarized embodiments are not necessarily representative of the claimed subject matter, nor do they span the scope of features described in more detail below. They simply serve as an introduction to the subject matter of the various inventions.

BRIEF DESCRIPTION OF THE DRAWINGS

So that the above recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DESCRIPTION OF THE EMBODIMENTS

Figure 1:
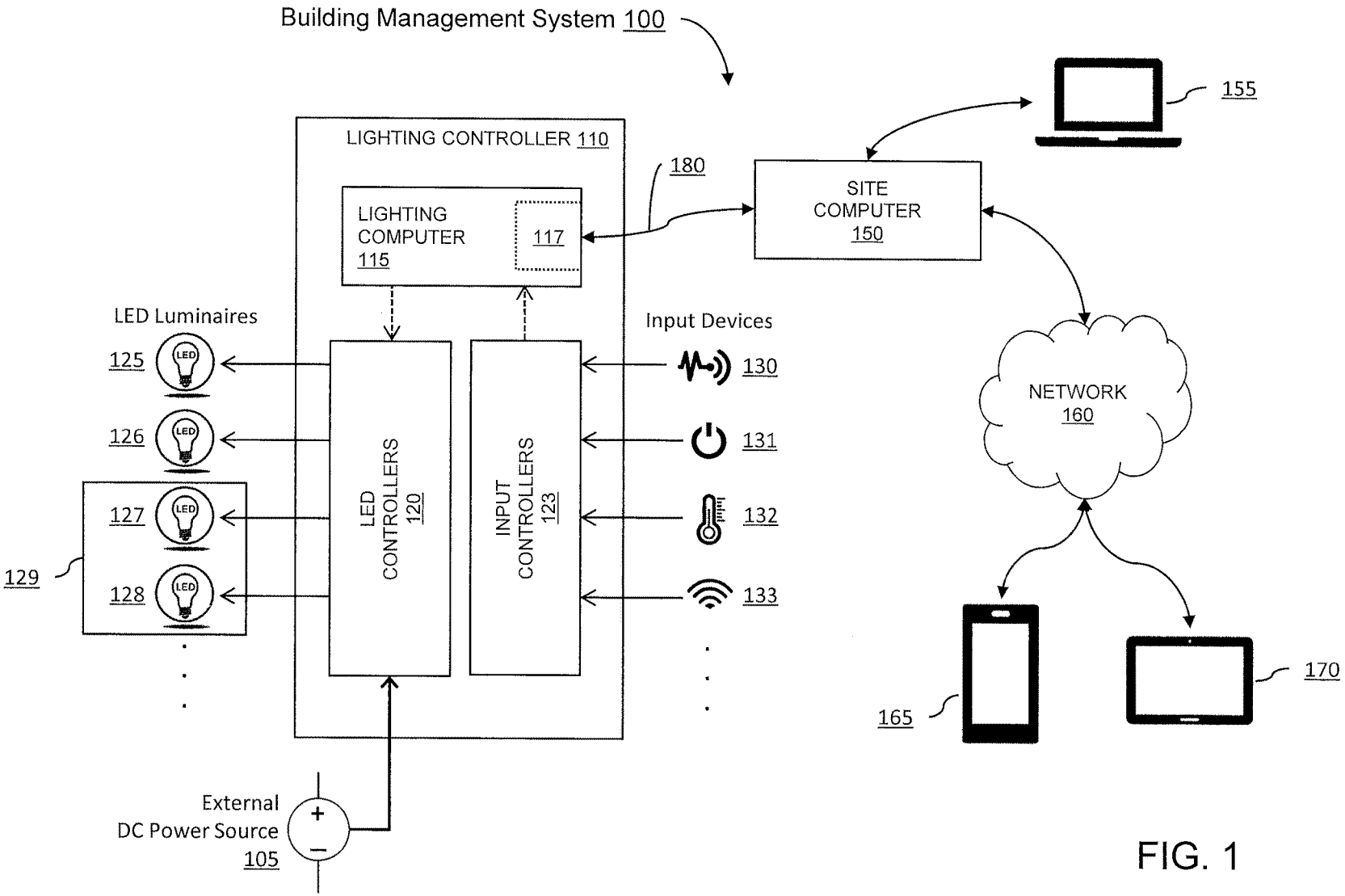
FIG. 1 is a block diagram illustrating an exemplary embodiment of a low power lighting controller within a building management system, in accordance with the present invention.

Embodiments of the present invention will be described with reference to the accompanying drawings, wherein like parts are designated by like reference numerals throughout, and wherein the leftmost digit of each reference number refers to the drawing number of the figure in which the referenced part first appears.

Overview and Definitions

As summarized above, embodiments of the present invention provide a novel approach for powering LED luminaires in office buildings, homes, industrial facilities, and similar structures using low-voltage direct current ("DC") electricity.

The term "LED luminaire," in the context of present invention, means a lighting component that includes at least one LED (light emitting diode) and may optionally include a plurality of LEDs, all of which are driven by DC electricity. In at least one embodiment, LED luminaires include nothing else but wiring. Specifically, in at least one embodiment, LED luminaires do not include a current driver that converts AC current to DC current, nor do they include a capacitor or an inductor to regulate current levels. In embodiments, these sub-components (e.g., current drivers, capacitors, and inductors) are located within a separate lighting controller enclosure, which provides low-voltage power to at least one LED luminaire and is preferably configured to provide low-voltage DC power to a plurality of LED luminaires.

When we use the term "building," we mean a relatively permanent enclosed structure over a plot of land, having a roof and usually windows and often having more than one level, which is used for any of a wide variety of activities, such as living, entertaining, working, or manufacturing. The term "building" includes office buildings, apartment buildings, condominium buildings, educational facilities, government facilities, industrial and/or manufacturing facilities, houses, and other similar structures.

Embodiments of the present invention use DC electricity to power and/or control LED lighting fixtures or luminaires. The DC voltage level used to power LED luminaires can range from 5 volts to 60 volts. A preferred voltage is approximately 48 volts. By using DC voltage from 5 volts to 60 volts, embodiments of the present invention can meet UL 2108 or Class 2 wiring standards, which require voltage levels to be less than 60 DC volts (in dry applications) and total power output ratings to be less than 100 watts. No conduit is required by Class 2 wiring standards, and the costs to install Class 2 lighting systems are accordingly much lower.

Building Management System 100

FIG. 1 is a block diagram illustrating an exemplary embodiment of a low power lighting controller within a building management system, in accordance with the present invention. In FIG. 1, building management system 100 comprises one or more low power lighting controllers 110, each of which may be connected to one or more LED luminaires 125-128 as well as one or more input devices 130-133. Each lighting controller 110 may be connected to a site computer 150 known in the art of building automation. Site computer 150 may be accessed via a communications network by a number of different user interface devices, including (1) a standard computer 155, such as a laptop or desktop computer that may communicate with site computer 150 via a hard-wire network cable; and/or (2) a smartphone 165 or tablet 170 or similar device (including a laptop computer), each of which may communicate with the site computer 150 via wireless network 160.

Lighting Controller 110

Lighting controller 110 may comprise a lighting computer 115, a plurality of LED controllers 120 in communication with the lighting computer 115, and a plurality of input controllers 123, also in communication with the lighting computer 115. The LED controllers 120 may be configured to power and/or control LED luminaires 125-128. Input controllers 123 may be configured to receive information from input devices 130-133.

Lighting Computer 115

Lighting computer 115 will typically comprise a single-chip microprocessor such as an ARM M4 Cortex 32-bit, 168 MHz processor from Texas Instruments, which may be configured to communicate with any of the plurality of LED controllers 120 via an internal bus. The communications that may occur between lighting computer 115 and any of the plurality of LED controllers 120 are well-known to those of ordinary skill in the art. The communications may comprise an output electrical signal to a specific one of the LED controllers 120, to cause it to provide a specific voltage to one of the connected LED luminaires 125. The communications may also comprise an input electrical signal sent from one of the input controllers 123 to lighting computer 115, to provide an indication of a signal transmitted by a specific input device, such as input device 131 (a switch). Lighting computer 115 may include a network transceiver 117 capable of being configured to communicate with other devices over a network cable 180 using a protocol such as the LonWorks network protocol. LonWorks is a protocol for networking devices over media such as twisted pair, powerlines, fiber optics, and RF. It is often used for the automation of various functions within buildings such as lighting and HVAC. Alternatively, site computer 150 may be configured to convert communications received from network transceiver 117 using one protocol, for example LonWorks, to another protocol, for example, BACnet IP.

Site Computer 150

Lighting computer 115 may communicate with site computer 150, also shown in FIG. 1. Site computer 150 may transmit configuration data over network cable 180 to lighting computer 115 to instruct lighting computer 115 to set the operational characteristics of any of the plurality of LED controllers 120. For example, one of the LED controllers 120 may be configured to provide power to a specific one of the LED luminaires 125-128, either at a specific power level or in incremental adjustments to achieve desired lighting levels and/or lighting temperatures/colors. As another example, one of the input controllers 123 may be configured to respond to an input signal from a temperature sensor, such as input device 133. At least some of these configuration data may be transmitted from site computer 150 to lighting computer 115.

Once the LED controllers 120 and the input controllers 123 have been configured, specific device-level commands and/or requests may be transmitted from site computer 150 to lighting computer 115. For example, site computer 150 may be programmed to send signals to lighting computer 115 at 6:00 am each business day to send additional signals to one of the LED controllers 120 to provide one of the LED luminaires 125-128, such as LED luminaire 125, with a certain voltage/amperage level that will cause the LED luminaire to output light at a color-temperature corresponding to strong daylight and to maintain that level until 5:00 pm, when site computer 150 may be programmed to send signals to lighting computer 115 to send additional signals to the same one of the LED controllers 120 to provide LED luminaire 125 with a different voltage/amperage level that will cause the LED luminaire to output light at a color-temperature corresponding to late-afternoon or dusk and to maintain that level until 8:00 pm, after which site computer 150 may be programmed to send signals to lighting computer 115 to deactivate the same one of the LED controllers 120 and its associated LED luminaire 125 (in other words to output a zero voltage/amperage level), which will cause the selected LED luminaire to go substantially dark.

One of ordinary skill in the art of device control will understand that many other signals, commands, and/or requests may be exchanged between site computer 150 and lighting computer 115 to configure LED controllers 120 and the input controllers 123 to send specific control and/or command signals to LED luminaires 125-128, and/or to accept status, sensor, state, and/or measurement data from input devices 130-133.

Site computer 150 may be controlled remotely by a user, either from a desktop computer 155 (or equivalent, including a laptop computer) connected to site computer 150 by a hard-wired network cable, or alternatively from a wireless device, such as a smartphone 165 or a tablet 170 (or equivalent, including a laptop computer) via a wireless network 160.

Communications with site computer 150 may be encrypted using protocols known by those skilled in the art.

LED Controllers 120

Each of the plurality of LED controllers 120 may provide electrical power to a corresponding one of LED luminaires 125-128 by outputting an appropriate DC power on the physical wires connected to that device. Several LED luminaires 125-128 are shown in FIG. 1 and are discussed in greater detail below. In a preferred embodiment, there may be twelve (12) LED controllers 120 and twelve (12) corresponding LED luminaires selected from LED luminaires 125-128.

Input Controllers 123

Each of the plurality of input controllers 123 may receive electrical signals from a corresponding one of input devices 130-133. Several input devices 130-133 are shown in FIG. 1 and are discussed in greater detail below. In a preferred embodiment, there may be ten (10) input controllers 123 and ten (10) corresponding input devices selected from input devices 130-133.

Each of the plurality of input controllers 123 may be configured or programmed to receive analog or digital voltage inputs at the following levels: 0-5 volts DC, 0-10 volts DC, and/or 4-20 volts DC. Each of the plurality of input controllers 123 may be fused, or all of them may be fused together.

LED Luminaires 125-128

As explained above, the term "LED luminaire," in the context of present invention, means a lighting component that includes at least one LED (light emitting diode) and may optionally include a plurality of LEDs, all of which are driven by DC electricity. In at least one embodiment, LED luminaires include nothing else but wiring. Specifically, in at least one embodiment, LED luminaires do not include a current driver that converts AC current to DC current, nor do they include a capacitor or an inductor to regulate current levels. In embodiments, these sub-components (e.g., current drivers, capacitors, and inductors) are located within each of the plurality of LED controllers 120, each of which may be configured to provide low-voltage DC power to at least one corresponding LED luminaire, for example LED luminaire 125.

Embodiments of the present invention contemplate various types and colors of LEDs. By selecting various combinations of LEDs within one LED luminaire, and by wiring each of the types of LEDs to a different one of the LED controllers 120, embodiments of the invention may vary the overall color and/or temperature of the light emitted by the LEDs by varying the DC voltage level that drives a selected set of LEDs. In other words, a single LED luminaire fixture, such as LED fixture 129, may comprise more than one LED luminaire, such as LED luminaire 127 and LED luminaire 128. To vary the DC voltage level that drives a selected set of LEDs within one of the plurality of LED luminaires 225-228, lighting computer 215 may transmit lighting control signals 280-283 to one or more of the LED controllers 220-223.

For example, one LED luminaire 127, may comprise one set of individual LEDs that output "cool" light (i.e., white light that is tuned slightly toward the blue end of the spectrum). Another LED luminaire 128 may comprise another set of LEDs that output "warm" light (i.e., white light that is tuned slightly toward the yellow or red end of the spectrum). The bluish LED luminaire 127 and the yellowish LED luminaire 128 may be combined into one LED fixture 129, such that the overall temperature of the light produced by the LED fixture 129 may be varied throughout the day using lighting control signals 282 and 283 in order to produce desired effects on circadian rhythms of people working and/or living within the building environment. For example, the overall temperature of the light produced by the LED fixture 129 may be varied throughout the day in order to mimic the color of the light produced by the sun during a typical day. The overall temperature of the light produced by the LED fixture 129 may be controlled by an input device such as any of input devices 130-133, as well as other devices, such as an external clock, an internal clock within lighting computer 115, or any other means known to those skilled in the art.

To provide colored lighting effects, four LED luminaires can be used, where one LED luminaire provides light in the red spectrum, a second LED luminaire provides light in the blue spectrum, a third LED luminaire provides light in the green spectrum, and a fourth LED luminaire provides white light covering the entire visible spectrum.

Input Device 130—Sensor

Input device 130 may comprise an analog or digital sensor or similar device, such as a light sensor, motion sensor, or occupancy sensor. When connected to one of the plurality of input controllers 123, input device 130 may provide data corresponding to a sensed interruption of visible light, a change in the level, color, or temperature of ambient visible light, a sensed interruption of infrared radiation, a change in the level, color, or temperature of infrared radiation. The data provided by input device 130 may be received by input controller 250 and then forwarded to lighting computer 215 via input signal 270.

Input Device 131—Switch

Input device 131 may comprise a switch or similar control device, including an on/off switch, a 2-position switch, a 4-position switch, a multi-position switch, a variable input control, a rheostat, a potentiometer, or similar device. When connected to one of the plurality of input controllers 123, input device 131 may provide data corresponding to a sensed activation, deactivation, or position of a manual switch. The data provided by input device 131 may be received by input controller 251 and then forwarded to lighting computer 215 via input signal 271.

Input Device 132—Temperature Sensor

Input device 132 may comprise an analog or digital temperature sensor or similar device. When connected to one of the plurality of input controllers 123, input device 132 may provide data corresponding to ambient temperature in a room or the temperature associated with a specific location or device, such as a computer room or a refrigerator. The data provided by input device 132 may be received by input controller 252 and then forwarded to lighting computer 215 via input signal 272.

Input Device 133—Wireless EnOcean Device

Input device 133 may comprise a device that may communicate with lighting computer 115 via wireless protocols, such as the EnOcean protocol. When an EnOcean antenna is connected to one of the plurality of input controllers 123, input device 133 may provide data transmitted wirelessly from a variety of devices, such as occupancy sensors, light sensors, key card switches, temperature sensors, humidity sensors, CO2 sensors, metering sensors, and the like. The data provided by input device 133 may be received by input controller 253 and then forwarded to lighting computer 215 via input signal 273.

Sensor Data May be Relayed

Data obtained from input devices 130-133 may be received by lighting computer 115 and may be relayed by lighting computer 115 to site computer 150 via network cable 180 for use elsewhere in a building automation system.

DC Power Source 105

DC voltage may be provided to the plurality of LED controllers 120 by external DC power source 105. The external DC power source 105 may comprise any type of common DC energy storage or supply, including a bank of batteries or a DC power converter connected to a utility power source. Off the shelf batteries may be used. Batteries may be charged by a connected renewable energy source such as photovoltaic solar array or similar power source. During periods that a renewable energy source is not available, a battery bank may be charged by a charger connected to utility power source.

In preferred embodiments, external DC power source 105 may provide DC electricity at approximately 48V to each of the plurality of LED controllers 120. Other voltage levels are possible, but to satisfy Class 2 wiring standards, the external DC power source 105 should provide DC electricity to each of the plurality of LED controllers 120 at less than 60V and a total power rating of less than 100 watts.

Lighting Controller 210

Figure 2:
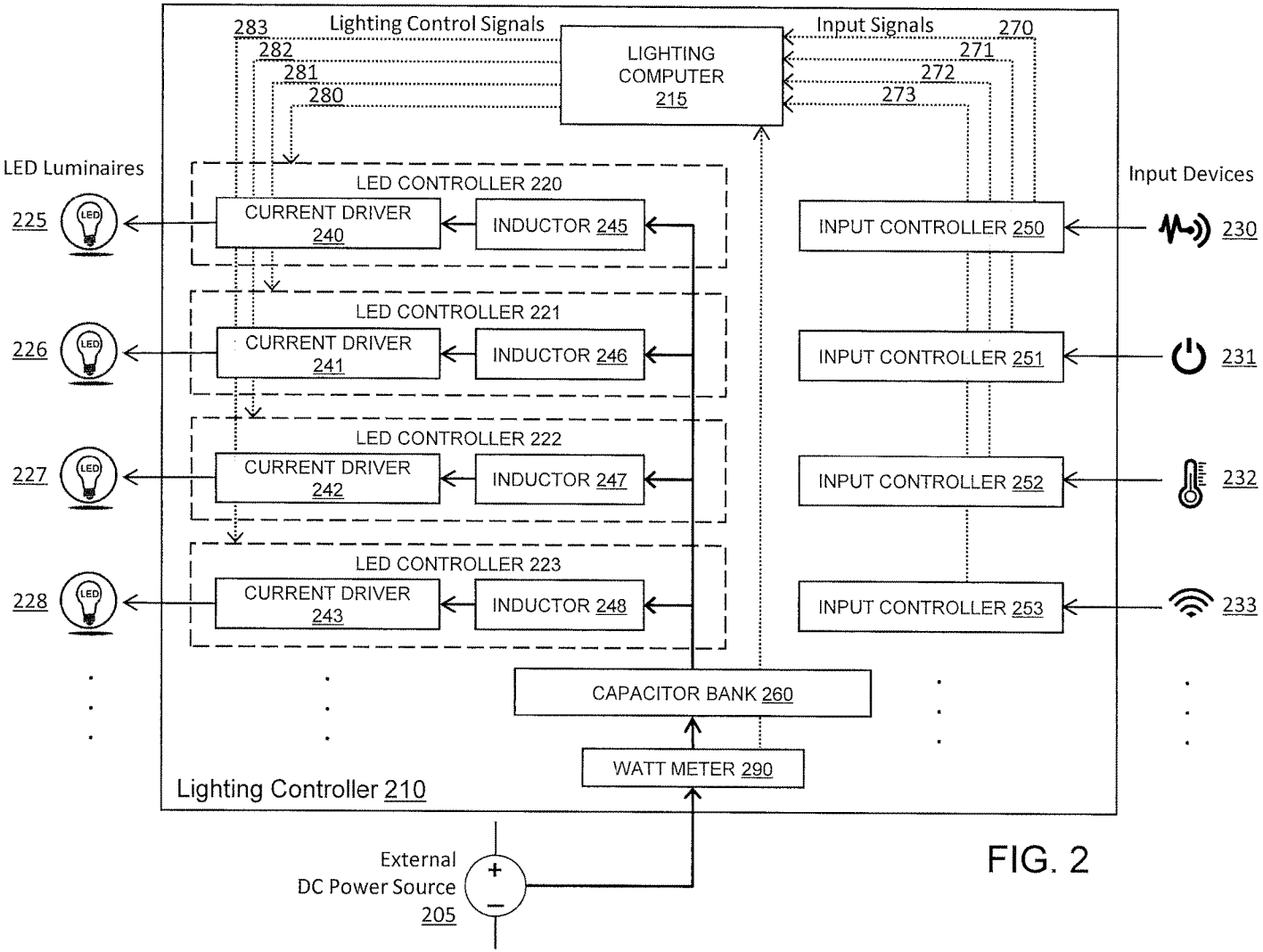
FIG. 2 is a block diagram illustrating an exemplary embodiment of a low power lighting controller with its component elements, in accordance with the present invention.

FIG. 2 is a block diagram illustrating an exemplary embodiment of a low power lighting controller with its component elements, in accordance with the present invention. In FIG. 2, the lighting controller 110 originally shown in FIG. 1 is illustrated in greater detail by lighting controller 210. Each lighting controller 210 may be connected to one or more LED luminaires 225-228 as well as one or more input devices 230-233. Each lighting controller 210 may be connected to a site computer 150, as described with respect to lighting controller 110 shown in FIG. 1.

Like lighting controller 110, lighting controller 210 may comprise a lighting computer 215 and a plurality of LED controllers 220-223.

LED Controllers 220

Each of the plurality of LED controllers 220-223 may provide electrical power to a corresponding one of LED luminaires 225-228 by outputting an appropriate DC power on the physical wires connected to that device. Several LED luminaires 225-228 are shown in FIG. 2 and are discussed in greater detail below. LED controllers 220-223 may be identical to LED controllers 120.

Input Controllers 250

Each of the plurality of input controllers 250-253 may receive electrical signals from a corresponding one of input devices 230-233. Several input devices 230-233 are shown in FIG. 2 and are discussed in greater detail below. In a preferred embodiment, there may be ten (10) input controllers selected from input controllers 250-253 and ten (10) corresponding input devices selected from input devices 230-233. Several input devices 230-233 are shown in FIG. 2 and are discussed in greater detail below. Input controllers 250-253 may be identical to input controllers 123.

DC Power Source 205

DC voltage may be provided to the plurality of LED controllers 220 by external DC power source 205, which may be identical to external DC power source 105. DC power source 205 may include a renewable energy source such as solar panels. DC power source 205 may comprise a battery power supply, including one or more backup batteries. DC power source 205 may comprise a resilient power bus. DC power source 205 may comprise a DC microgrid.

DC voltage may flow from DC power source 205 to an optional watt meter 290 configured to measure the amount of current flowing from DC power source 205 and report that measurement, to lighting computer 215. Watt meter 290 may be configured to report the amount of current on a periodic basis or when requested.

External DC power source 205 may provide DC power to the plurality of LED controllers 220 via a capacitor bank 260, optionally through watt meter 290. Capacitor bank 260 may comprise a plurality of capacitors connected in parallel. Capacitor bank 260 may operate to smooth and average the output of DC power source 205 to the plurality of LED controllers 220.

Each of the LED controllers 220-223 may comprise an inductor 245-248 and a corresponding current driver 240-243. For example, LED controller 220 may comprise inductor 245 and current driver 240. It is possible for a single current driver to power more than one LED luminaire, but the preferred embodiment uses a one-to-one configuration.

A current driver, such as one selected from current drivers 240-243, may output current at any level from 0-48 volts DC, and from 0-20 mA DC, one channel per output. Each output channel may be fused, or all outputs together may be fused.

The DC power output from the capacitor bank 260 may be connected in parallel to the input side of the inductors 245-248, each of which provides DC power to a corresponding one of the plurality of current drivers 240-243. For example, inductor 245 may accept DC power from capacitor bank 260 and may provide DC power to current driver 240, which may then provide DC power to LED luminaire 225.

In embodiments, capacitor bank 260 can provide power to all inductors 245-248 at the same time, so power consumption by the current drivers 240-243 can be averaged.

In embodiments, each of the current drivers 240-243 may use a switch to allow current to flow through an LED luminaire many times per second. Without the inductors 245-248, the current flow would be either full on or full off. Light output varies with current flow. If the current flow switches quickly from on to off, LED lights will flicker. Inductors 245-248 store energy and allow current to flow during the switch off periods, thereby eliminating light flicker effects known to be an unacceptable side effect in LED lighting systems.

The amperage required by embodiments of the present invention can be determined from the number of LED luminaires connected to each lighting controller 210. For example, each LED luminaire may require approximately 2 amps. Thus, if a controller such as lighting controller 210 is configured to control 4 different LED luminaires and each of the connected luminaires requires 2 amps of electricity at 48 volts DC, the LED controller 220 should be configured to be capable of providing a total of 8 amps of electricity at 48 volts DC. Similarly, each wire that connects an LED luminaire to a controller should be capable of carrying 2 amps at the required voltage.

LED Luminaires 225-228

LED luminaires 225-228 may correspond to LED luminaires 125-128.

Input Devices 230-233

Input devices 230-233 may correspond to input devices 130-133.

Features of Embodiments

Embodiments of the present invention can provide electricity to multiple LED luminaires, sending low voltage <60V and low power <100 W from a single lighting controller (such as lighting controller 110), thereby eliminating the need for individual current drivers in each LED luminaire. Instead of running high voltage wires to each luminaire and including a separate current driver in each luminaire, embodiments of the present invention power several luminaires from one lighting controller.

With respect to lighting control, lighting computer 115 (or 215) in lighting controller 110 (or 210) may process commands received from site computer 150 to perform many different functions, including: (1) general automation control over connected LED luminaires; (2) selection-activation of each connected LED luminaire; (3) color-selection, illumination selection, dimming, and/or light-temperature-selection of each connected LED luminaire, separately or in combination; and (4) management of excess heat produced by each connected LED luminaire.

Lighting controller 110 (or 210) can be connected by a network cable 180 (or optionally by other communication protocols known in the art, including a variety of wireless protocols) to a site computer 150 and then to a network 160, through which a lighting computer 115 (or 215) within lighting controller 110 (or 210) may receive sensor values from input devices 130-133 via input signals 270-273 and may publish those sensor values to other computers in a building management system 100. Lighting computer 115 (or 215) may also receive commands from a site computer 150 to turn selected LED luminaires on or off, to change their color and/or temperature characteristics, and to perform other functions known in the art of building automation.

Lighting controller 110 (or 210) can be connected to a building device network so LED luminaires can be controlled from an external source. Lighting controller 110 (or 210) can also control LED current drivers via lighting control signals 280-283 and thereby manage the color, temperature, and brightness of each LED luminaire 225-228 to achieve desired dimming and color tuning.

Embodiments of the present invention can increase system efficiency and resilience by directly accepting as an input an external low-voltage DC voltage source of less than 60V. This is different from current industry standards, which use 120-277V AC for lighting. Such an architecture eliminates multiple stages of power translation.

Embodiments of the present invention provide an architecture for delivering power to LED lighting systems that provides a higher level of system resiliency than existing AC systems because it uses DC voltage and it directly incorporates renewable energy sources. This approach eliminates multiple stages of voltage translation as present in lighting systems today. Also, by eliminating multiple stages of voltage translation, the overall system efficiency increases and corresponding energy losses decrease.

Currently, only licensed electricians are permitted to work on lighting systems, due to their use of dangerous high voltage AC power. Embodiments of the present invention eliminate high voltage wiring requirements from lighting systems and instead use Class 2 low-voltage wiring to power the LED luminaires, thus eliminating exposure to high voltage power and reducing costs of installation.

Embodiments of the present invention lower the cost of lighting system maintenance by allowing access to all electronic hardware at one location. Any parts that need to be serviced can be accessed in a convenient and single location reducing maintenance time and cost.

Embodiments of the present invention benefit from a resilient power bus. This topology can provide uninterrupted lighting even during power grid outages.

Embodiments of the present invention do not translate voltage, because LED current drivers are connected directly to the same power bus as the backup batteries. Renewable energy sources provide battery charging when possible, and the rest of the required energy may come from the power grid by way of a power supply unit capable of converting AC power to DC, as well as charging backup batteries.

Embodiments of the present invention allow for a slim, compact design and exotic form factors by removing AC-powered current drivers that are found in existing prior-art LED luminaires. Using embodiments of the present invention, the wired connection from the LED controller to the LED luminaire can be a thin low voltage wire, which is easy to hide allowing for artful and aesthetically pleasing luminaire design.

Computing Device

Figure 3:
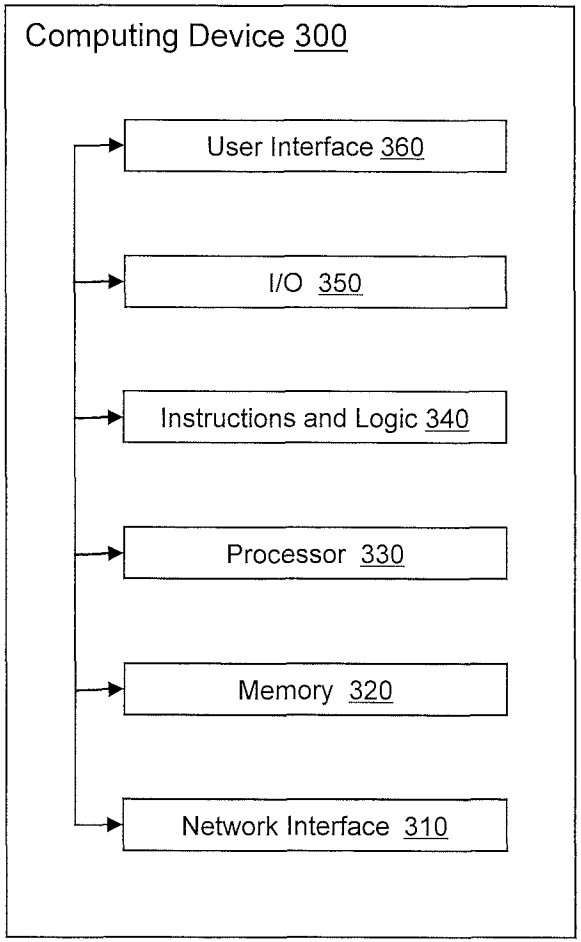
FIG. 3 is a block diagram of an exemplary embodiment of a computing device, in accordance with the present invention.

FIG. 3 is a block diagram of an exemplary embodiment of a computing device, in accordance with the present invention, which in certain operative embodiments can comprise, for example, lighting computer 115 and/or lighting computer 215. Computing Device 300 can comprise any of numerous components, such as for example, one or more Network Interfaces 310, one or more Memories 320, one or more Processors 330 including program Instructions and Logic 340, one or more Input/Output (I/O) Devices 350 (including LED luminaires 125-128, LED luminaires 225-228, input devices 130-133, and input devices 250-258), and one or more User Interfaces 360 that may be coupled to the I/O Device(s) 350, etc.

Computing Device 300 may comprise any device known in the art that is capable of processing data and/or information, such as any general purpose and/or special purpose computer, including as a personal computer, workstation, server, minicomputer, mainframe, supercomputer, computer terminal, laptop, tablet computer (such as an iPad), wearable computer, mobile terminal, Bluetooth device, communicator, smart phone (such as an iPhone, Android device, or BlackBerry), a programmed microprocessor or microcontroller and/or peripheral integrated circuit elements, an ASIC or other integrated circuit, a hardware electronic logic circuit such as a discrete element circuit, and/or a programmable logic device such as a PLD, PLA, FPGA, or PAL, or the like, etc. In general, any device on which a finite state machine resides that is capable of implementing at least a portion of the methods, structures, API, and/or interfaces described herein may comprise Computing Device 300. Such a Computing Device 300 can comprise components such as one or more Network Interfaces 310, one or more Processors 330, one or more Memories 320 containing Instructions and Logic 340, one or more Input/Output (I/O) Devices 350, and one or more User Interfaces 360 coupled to the I/O Devices 350, etc.

Memory 320 can be any type of apparatus known in the art that is capable of storing analog or digital information, such as instructions and/or data. Examples include a non-volatile memory, volatile memory, Random Access Memory, RAM, Read Only Memory, ROM, flash memory, magnetic media, hard disk, solid state drive, floppy disk, magnetic tape, optical media, optical disk, compact disk, CD, digital versatile disk, DVD, and/or RAID array, etc. The memory device can be coupled to a processor and/or can store instructions adapted to be executed by processor, such as according to an embodiment disclosed herein.

Input/Output (I/O) Device 350 may comprise any sensory-oriented input and/or output device known in the art, such as an audio, visual, haptic, olfactory, and/or taste-oriented device, including, for example, a monitor, display, projector, overhead display, keyboard, keypad, mouse, trackball, joystick, gamepad, wheel, touchpad, touch panel, pointing device, microphone, speaker, video camera, camera, scanner, printer, vibrator, tactile simulator, and/or tactile pad, optionally including a communications port for communication with other components in Computing Device 300. Input/Output (I/O) Device 350 may comprise LED luminaires 125-128, LED luminaires 225-228, input devices 130-133, and input devices 250-258.

Instructions and Logic 340 may comprise directions adapted to cause a machine, such as Computing Device 300, to perform one or more particular activities, operations, or functions. The directions, which can sometimes comprise an entity called a "kernel", "operating system", "program", "application", "utility", "subroutine", "script", "macro", "file", "project", "module", "library", "class", "object", or "Application Programming Interface," etc., can be embodied as machine code, source code, object code, compiled code, assembled code, interpretable code, and/or executable code, etc., in hardware, firmware, and/or software. Instructions and Logic 340 may reside in Processor 330 and/or Memory 320.

Network Interface 310 may comprise any device, system, or subsystem capable of coupling an information device to a network. For example, Network Interface 310 can comprise a telephone, cellular phone, cellular modem, telephone data modem, fax modem, wireless transceiver, Ethernet circuit, cable modem, digital subscriber line interface, bridge, hub, router, or other similar device. Network Interface 310 may comprise a transceiver, such as transceiver 117, which may be capable of communicating via a protocol such as LonWorks, and the like.

Processor 330 may comprise a device and/or set of machine-readable instructions for performing one or more predetermined tasks. A processor can comprise any one or a combination of hardware, firmware, and/or software. A processor can utilize mechanical, pneumatic, hydraulic, electrical, magnetic, optical, informational, chemical, and/or biological principles, signals, and/or inputs to perform the task(s). In certain embodiments, a processor can act upon information by manipulating, analyzing, modifying, converting, transmitting the information for use by an executable procedure and/or an information device, and/or routing the information to an output device. A processor can function as a central processing unit, local controller, remote controller, parallel controller, and/or distributed controller, etc. Unless stated otherwise, the processor can comprise a general-purpose device, such as a microcontroller and/or a microprocessor, such the Pentium IV series of microprocessors manufactured by the Intel Corporation of Santa Clara, Calif. In certain embodiments, the processor can be dedicated purpose device, such as an Application Specific Integrated Circuit (ASIC) or a Field Programmable Gate Array (FPGA) that has been designed to implement in its hardware and/or firmware at least a part of an embodiment disclosed herein. Processor 330 may comprise an ARM M4 Cortex 32-bit, 168 MHz processor from Texas Instruments or any reasonable equivalent.

User Interface 360 may comprise any device and/or means for rendering information to a user and/or requesting information from the user. User Interface 360 may include, for example, at least one of textual, graphical, audio, video, animation, and/or haptic elements. A textual element can be provided, for example, by a printer, monitor, display, projector, etc. A graphical element can be provided, for example, via a monitor, display, projector, and/or visual indication device, such as a light, flag, beacon, etc. An audio element can be provided, for example, via a speaker, microphone, and/or other sound generating and/or receiving device. A video element or animation element can be provided, for example, via a monitor, display, projector, and/or other visual device. A haptic element can be provided, for example, via a very low frequency speaker, vibrator, tactile stimulator, tactile pad, simulator, keyboard, keypad, mouse, trackball, joystick, gamepad, wheel, touchpad, touch panel, pointing device, and/or other haptic device, etc. A user interface can include one or more textual elements such as, for example, one or more letters, number, symbols, etc. A user interface can include one or more graphical elements such as, for example, an image, photograph, drawing, icon, window, title bar, panel, sheet, tab, drawer, matrix, table, form, calendar, outline view, frame, dialog box, static text, text box, list, pick list, pop-up list, pull-down list, menu, tool bar, dock, check box, radio button, hyperlink, browser, button, control, palette, preview panel, color wheel, dial, slider, scroll bar, cursor, status bar, stepper, and/or progress indicator, etc. A textual and/or graphical element can be used for selecting, programming, adjusting, changing, specifying, etc. an appearance, background color, background style, border style, border thickness, foreground color, font, font style, font size, alignment, line spacing, indent, maximum data length, validation, query, cursor type, pointer type, auto-sizing, position, and/or dimension, etc. A user interface can include one or more audio elements such as, for example, a volume control, pitch control, speed control, voice selector, and/or one or more elements for controlling audio play, speed, pause, fast forward, reverse, etc. A user interface can include one or more video elements such as, for example, elements controlling video play, speed, pause, fast forward, reverse, zoom-in, zoom-out, rotate, and/or tilt, etc. A user interface can include one or more animation elements such as, for example, elements controlling animation play, pause, fast forward, reverse, zoom-in, zoom-out, rotate, tilt, color, intensity, speed, frequency, appearance, etc. A user interface can include one or more haptic elements such as, for example, elements utilizing tactile stimulus, force, pressure, vibration, motion, displacement, temperature, etc.

The present invention can be realized in hardware, software, or a combination of hardware and software. The invention can be realized in a centralized fashion in one computer system, or in a distributed fashion where different elements are spread across several computer systems. Any kind of computer system or other apparatus adapted for carrying out the methods described herein is suitable. A typical combination of hardware and software can be a general-purpose computer system with a computer program that, when being loaded and executed, controls the computer system such that it carries out the methods described herein.

Although the present disclosure provides certain embodiments and applications, other embodiments apparent to those of ordinary skill in the art, including embodiments that do not provide all of the features and advantages set forth herein, are also within the scope of this disclosure.

The present invention, as already noted, can be embedded in a computer program product, such as a computer-readable storage medium or device which when loaded into a computer system is able to carry out the different methods described herein. "Computer program" in the present context means any expression, in any language, code or notation, of a set of instructions intended to cause a system having an information processing capability to perform a particular function either directly or indirectly after either or both of the following: a) conversion to another language, code or notation; or b) reproduction in a different material form.

The foregoing disclosure has been set forth merely to illustrate the invention and is not intended to be limiting. It will be appreciated that modifications, variations and additional embodiments are covered by the above teachings and within the purview of the appended claims without departing from the spirit and intended scope of the invention. Other logic may also be provided as part of the exemplary embodiments but are not included here so as not to obfuscate the present invention. Since modifications of the disclosed embodiments incorporating the spirit and substance of the invention may occur to persons skilled in the art, the invention should be construed to include everything within the scope of the appended claims and equivalents thereof.

The invention claimed is:

1. A low-power lighting control system for a building, comprising:

(a) a power source configured to provide electricity at approximately 48 volts DC;

(b) a variable input control device;

(c) an LED lighting fixture comprising a cool LED luminaire and a warm LED luminaire, said cool LED luminaire configured to be powered by DC electricity, said cool LED luminaire lacking any local current driver to convert AC electricity to DC electricity, said cool LED luminaire comprising one or more cool LEDs that are tuned toward a blue end of a visible light spectrum, said warm LED luminaire configured to be powered by DC electricity, said warm LED luminaire lacking any local current driver to convert AC electricity to DC electricity, said warm LED luminaire comprising one or more warm LEDs that are tuned toward a red end of the visible light spectrum; and (d) a lighting controller comprising a watt meter, a capacitor bank, a cool LED controller, a warm LED controller, an input controller, and a lighting computer;

said watt meter electrically coupled to the power source, said watt meter configured to measure the number of watts of DC electricity consumed by the capacitor bank, said watt meter configured to communicate the watt measurement to the lighting computer, said capacitor bank electrically coupled to and configured to receive DC electricity through the watt meter, said capacitor bank including a plurality of capacitors arranged in parallel, said capacitor bank configured to provide DC electricity to the cool LED controller and the warm LED controller, said cool LED controller including a first inductor configured to receive DC electricity from the capacitor bank and a first current driver configured to receive DC electricity from the first inductor, said cool LED controller configured to output DC electricity from the first current driver via a first Class 2 wire (a Class 2 wire is one that is rated to carry from 5 volts to 60 volts of DC electricity) to the cool LED luminaire according to a cool lighting control signal received from the lighting computer, said cool lighting control signal specifying a particular first voltage level and a first amperage level for the cool LED luminaire, said warm LED controller including a second inductor configured to receive DC electricity from the capacitor bank and a second current driver configured to receive DC electricity from the second inductor, said warm LED controller configured to output DC electricity from the second current driver via a second Class 2 wire to the warm LED luminaire according to a warm lighting control signal received from the lighting computer, said warm lighting control signal specifying a particular second voltage level and a second amperage level for the warm LED luminaire, said input controller configured to receive a light temperature input signal from the variable input control device, where the light temperature input signal indicates a desired balance of cool and warm light corresponding to a manual setting on the variable input control device, said lighting computer configured to receive the light temperature input signal from the input controller, said lighting computer configured to issue the cool lighting control signal to the cool LED controller and to issue the warm lighting control signal to the warm LED controller, where the cool lighting control signal and the warm lighting control signal correspond to the desired balance of cool and warm light indicated by the light temperature input signal, and said lighting computer configured to receive an instruction from a site computer via a building network, said instruction comprising a command to turn the LED lighting fixture off.

2. The low-power lighting control system of claim 1, where the power source is a solar panel on a microgrid.

3. The low-power lighting control system of claim 1, where the power source is a battery on a microgrid.

4. The low-power lighting control system of claim 1, where the lighting computer is configured to transmit the watt measurement to the site computer.

5. The low-power lighting control system of claim 1, where the lighting computer is configured to transmit the light temperature input signal to the site computer.

6. The low-power lighting control system of claim 1, where said input controller configured to receive the light temperature input signal from the variable input control device via a third Class 2 wire.

7. The low-power lighting control system of claim 1, where said input controller configured to receive the light temperature input signal from the variable input control device via a wireless antenna.

* * * * *